US005975844A

United States Patent [19]

Milazar et al.

[11] Patent Number: 5,975,844

[45] Date of Patent: Nov. 2, 1999

[54] SEALING ELEMENT FOR SEALING A GAP AND GAS TURBINE PLANT

[75] Inventors: Mirko Milazar, Oberhausen; Friedhelm Terschüren, Essen; Alfred Lienert, Mülheim/Ruhr, all of Germany

[73] Assignee: Siemens Aktiengesellschaft, Munich, Germany

[21] Appl. No.: 09/052,344

[22] Filed: Mar. 30, 1998

Related U.S. Application Data

[63] Continuation of application No. PCT/DE96/01861, Sep. 27, 1996.

[30] Foreign Application Priority Data

Sep. 29, 1999 [DE] Germany ..... 195 36 535

[51] Int. Cl.[6] ..... F16J 15/00

[52] U.S. Cl. ..... 415/138; 415/135; 415/136; 415/139; 415/173.3; 277/643; 277/644; 277/648

[58] Field of Search ..... 415/135, 136, 415/138, 139, 173.1, 173.3, 173.5, 174.2, 174.5, 209.2, 209.3; 277/643, 644, 648

[56] References Cited

U.S. PATENT DOCUMENTS

| | | | |
|---|---|---|---|
| 1,816,293 | 7/1931 | Oberhuber . | |
| 2,991,045 | 7/1961 | Tassoni . | |
| 3,341,172 | 9/1967 | Rahaim . | |
| 4,063,845 | 12/1977 | Allen | 415/134 |
| 4,537,024 | 8/1985 | Grosjean . | |
| 5,058,906 | 10/1991 | Adamek et al. . | |
| 5,158,430 | 10/1992 | Dixon et al. | 415/134 |
| 5,221,096 | 6/1993 | Heldreth et al. . | |
| 5,374,161 | 12/1994 | Kelch et al. | 415/139 |
| 5,509,669 | 4/1996 | Wolfe et al. | 277/167.5 |
| 5,586,773 | 12/1996 | Bagepalli et al. | 277/167.5 |

FOREIGN PATENT DOCUMENTS 0 139 072 A1 5/1985 European Pat. Off. .

OTHER PUBLICATIONS

Patent Abstracts of Japan No. 58–185903 (Takeshita), dated Oct. 29, 1983.

*Primary Examiner*—F. Daniel Lopez
*Assistant Examiner*—Matthew T. Shanley
*Attorney, Agent, or Firm*—Herbert L. Lerner; Laurence A. Greenberg

[57] ABSTRACT

A sealing element seals a gap which may be formed between two components that are movable thermally relative to one another. Each component has a component groove located one opposite the other. The sealing element is directed along a center line, in a cross-section essentially perpendicular to a main line, and has a first end, a second end located opposite the first end and a toothed middle region located between the ends. The sealing element is suitable in particular for sealing off a gap between guide blades at high temperatures in a gas turbine plant for the purpose of preventing a gas flow out of a cooling-gas region into a hot-gas region. A gas turbine plant is provided with the sealing element for sealing the gap.

13 Claims, 2 Drawing Sheets

SEALING ELEMENT FOR SEALING A GAP AND GAS TURBINE PLANT

CROSS-REFERENCE TO RELATED APPLICATION

This application is a continuation of International Application PCT/DE96/01861, filed Sep. 27, 1996 which designated the United States.

BACKGROUND OF THE INVENTION

Field of the Invention

The invention relates to a sealing element for sealing a gap which may be formed between two components being movable thermally relative to one another and each having a component groove located one opposite the other, particularly in a gas turbine plant. The invention also relates to a gas turbine plant having sealing elements.

In industrial plants, particularly thermomechanical machines and chemical plants, in which different fluids are used, it may be necessary to keep those fluids separate from one another within the plants. For example, in thermal combustion power plants, flow regions of hot combustion gases have to be separated sealingly from flow regions of cooling gases of lower temperature. In gas turbine plants with high turbine inlet temperatures, for example of more than 1000° C., thermal expansions of the individual components of the gas turbine plant occur, so that adjacent components are sometimes spaced from one another through the use of a gap in order to avoid high thermal stresses and the formation of cracks. Such gaps may constitute connections between flow regions of hot gases and flow regions of cold gases. It is advantageous to seal off the gap to reduce the inflow of cold gas into the flow region of hot gases so as not to thereby lower the temperature in the flow region of hot gases.

U.S. Pat. No. 3,341,172 and U.S. Pat. No. 2,991,045, each of which describe a gas turbine with an outer casing and a two-part inner casing, accordingly specify a sealing element that has a cross-section in the shape of an elongate C for sealing a gap between the two inner casings. An annular gap, through which cooling fluid is guided, is formed between the inner casing and the outer casing. The hot gas for driving the gas turbine flows within the inner casing.

U.S. Pat. No. 4,537,024 describes a gas turbine plant, in which components of a nozzle structure are sealed through the use of axial and radial sealing elements. The sealing elements are intended to prevent hot gas which flows through the nozzle structure from infiltrating into turbine regions outside the hot-gas duct. A sealing element can have approximately the shape of a squashed eight as seen in cross-section.

U.S. Pat. No. 1,816,293 relates to a leak-proof connection of two hot-steam conduits. That steam-proof connection is made by firmly screwing two flanges together. The flanges each have an annular sealing surface which is toothed. The teeth of the sealing surfaces that are pressed onto one another are deformed in order to achieve an increased sealing effect. A sealing ring, which is toothed on both sides and through which the same sealing effect is achieved, is alternatively or additionally inserted between the flanges.

SUMMARY OF THE INVENTION

It is accordingly an object of the invention to provide a sealing element for sealing a gap and to provide a gas turbine plant, which overcome the hereinafore-mentioned disadvantages of the heretofore-known products and devices of this general type, in which the sealing element may be formed between two components that are freely movable thermally relative to one another for guaranteeing effective sealing even in the event of thermal expansions of the components and in which the gas turbine plant has a region carrying hot gas that is sealed off effectively from a region carrying a cooling fluid, particularly cooling air.

With the foregoing and other objects in view there is provided, in accordance with the invention, in an assembly including two mutually thermally movable components each having a component groove located one opposite the other, a sealing element directed along a main line for sealing a gap between the components, the sealing element comprising a first end, a second end opposite the first end and a middle region, in a cross-section substantially perpendicular to the main line, along a center line, the middle region disposed between the ends and having a toothed first surface.

By virtue of the toothing of the sealing element, on one hand it can be adapted to the shape of the respective component groove, so that it bears sealingly in each component groove and, on the other hand, it is deformable, with the result that it can match a thermal expansion of the components. Thus, the gap is furthermore sealed off and inadmissible thermal stresses are avoided. Depending on the type of toothing and the choice of material for the sealing element, the latter can be employed for use at high temperatures of more than 1000° C. It is therefore preferably suitable for use in a thermal combustion engine, particularly a gas turbine plant.

Preferably, the sealing element is deformable, at least at the ends, in a direction essentially orthogonal to the center line. This ensures that in the event of a thermal expansion of the component groove in the direction of the center line of the sealing element, the ends can match this thermal expansion and the sealing element therefore bears sealingly in the component grooves, without giving rise to inadmissibly high thermal stresses. A virtually play-free connection is thereby afforded between the components and the sealing element. Moreover, due to the deformability of the sealing element, the movability of the components relative to one another continues to be guaranteed.

The center line of the sealing element is preferably a center axis, so that the sealing element is essentially plane. It can be produced simply and on a large scale with a fluted (toothed) surface from an essentially plane metal sheet having a predetermined wall thickness.

In accordance with another feature of the invention, the sealing element has sealing grooves which are each inclined at an angle of inclination of 50° to 90° relative to the center line. The sealing grooves preferably run essentially in the direction of the main line. By virtue of the sealing grooves, the sealing element acquires profiling which guarantees deformability both orthogonal to and in the direction of the center line. Deformability in a direction essentially orthogonal to the center line is guaranteed, particularly in the case of a non-orthogonal path of the sealing grooves, that is to say at an angle of inclination of less than 90° relative to the center line.

In accordance with again another feature of the invention, the sealing grooves are inclined so as to ascend towards the middle region.

In accordance with a further feature of the invention, the angle of inclination of the sealing grooves is smaller at the ends than in the middle region. This ensures that the sealing element can match the thermal expansions of the components particularly closely at the ends projecting into the component grooves, thereby achieving particularly good sealing.

In accordance with an added feature of the invention, the sealing element has a first surface and a second surface each of which run between the ends and are located opposite one another with respect to the center line, the first surface is toothed and the second surface is smooth. In a gas turbine plant having a cooling-gas region and a region carrying hot gas, the toothed surface preferably faces the cooling-gas region and the smooth surface faces the hot-gas region. The advantage thereof is that, in the event of a higher pressure in the cooling-gas region than in the region carrying hot gas, the sealing element rests on the smooth second surface while the gas turbine plant is in operation. Sealing tips located between adjacent sealing grooves are therefore exposed to virtually no wear, and reliable and good sealing is guaranteed over a long period of time.

In accordance with an additional feature of the invention, the sealing element narrows from the middle region towards the respective ends. Since the ends project into a respective component groove and, in the event of thermal expansion of the components relative to one another, the gap between them becomes smaller, the sealing element penetrates further into the respective component groove at rising temperatures. The narrowing towards the ends ensures that the sealing element bears even more sealingly in the respective component groove and the sealing-off of the gap is thus further improved, in the event of rising temperature.

In accordance with yet another feature of the invention, the sealing element is suitable for sealing off a gap in a gas turbine plant with a region carrying hot gas and a cooling-gas region to be sealed off from the latter for cooling guide blades of the gas turbine plant, the sealing element disposed in such a way that it engages, on one hand, into a component groove of a first component, particularly a guide blade or a wall component of the gas turbine plant and, on the other hand, into a component groove of a second component, particularly a further guide blade or a wall component, adjacent the first component, with a gap being formed between the components. Guide blades and moving blades are disposed alternately in the direction of the main axis of the gas turbine plant, with the guide blades being fastened with their guide-blade plates to a casing of the gas turbine plant and a region for the guidance of cooling gas being provided between the guide blade and the casing. A wall component of the gas turbine plant is adjacent each guide blade in the axial direction, so as to separate the cooling-gas region from the region carrying hot gas. A gap which is formed between the wall component and, in particular, the guide-blade plate, is preferably sealed off by the sealing element. In each case guide blades are disposed in the circumferential direction of the gas turbine plant and are spaced from one another through the use of a respective gap. The wall components which are disposed in the region of the moving blades are likewise spaced from one another through the use of a corresponding gap. The gaps between adjacent guide blades and adjacent wall components are preferably sealed off by a sealing element.

In accordance with yet a further feature of the invention, the sealing elements are constructed at their ends with a slight excess relative to the component grooves into which they are inserted, in order to provide effective sealing-off even when the gas turbine plant is started up, that is to say heated up, and when the gas turbine plant is run down and cooled. As a result, effective sealing-off of the gaps is achieved, irrespective of the temperature momentarily prevailing in the gas turbine plant and of the temperature difference between the cooling-gas region and the region carrying hot gas.

In accordance with yet an added feature of the invention, the sealing element seals off a gap between two components having component grooves which narrow away from the gap into the components. The degree of narrowing, in particular a corresponding bevel angle, is preferably adapted to the operating temperature of the gas turbine plant.

In accordance with yet an additional feature of the invention, the toothed surface faces the cooling-gas region.

With the objects of the invention in view there is also provided a gas turbine plant, comprising a plurality of components disposed in axial and circumferential direction, at least a first component, in particular a guide-blade plate or a wall component, and a second component, in particular a guide-blade plate or a wall component, being adjacent and spaced apart in the circumferential direction by a gap, and each of the components having a component groove facing the gap; regions mutually separated by the components and the gap, the regions including a hot-gas region and a cooling-gas region to be sealed off from the hot-gas region for cooling the guide blades; and a toothed (fluted) sealing element disposed in the component grooves for sealing the gap.

While the gas turbine plant is operating normally, hot gas (up to more than 1000° C.) flows through the hot-gas region and cooling air flows through the cooling-fluid region.

In accordance with a concomitant feature of the invention, the components that are spaced in the axial direction, namely a guide-blade plate and a wall component located opposite a moving blade, are sealed off through the use of a particularly dumbbell-shaped or figure-eight sealing element constructed as a hollow body.

Other features which are considered as characteristic for the invention are set forth in the appended claims.

Although the invention is illustrated and described herein as embodied in a sealing element for sealing a gap and a gas turbine plant, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
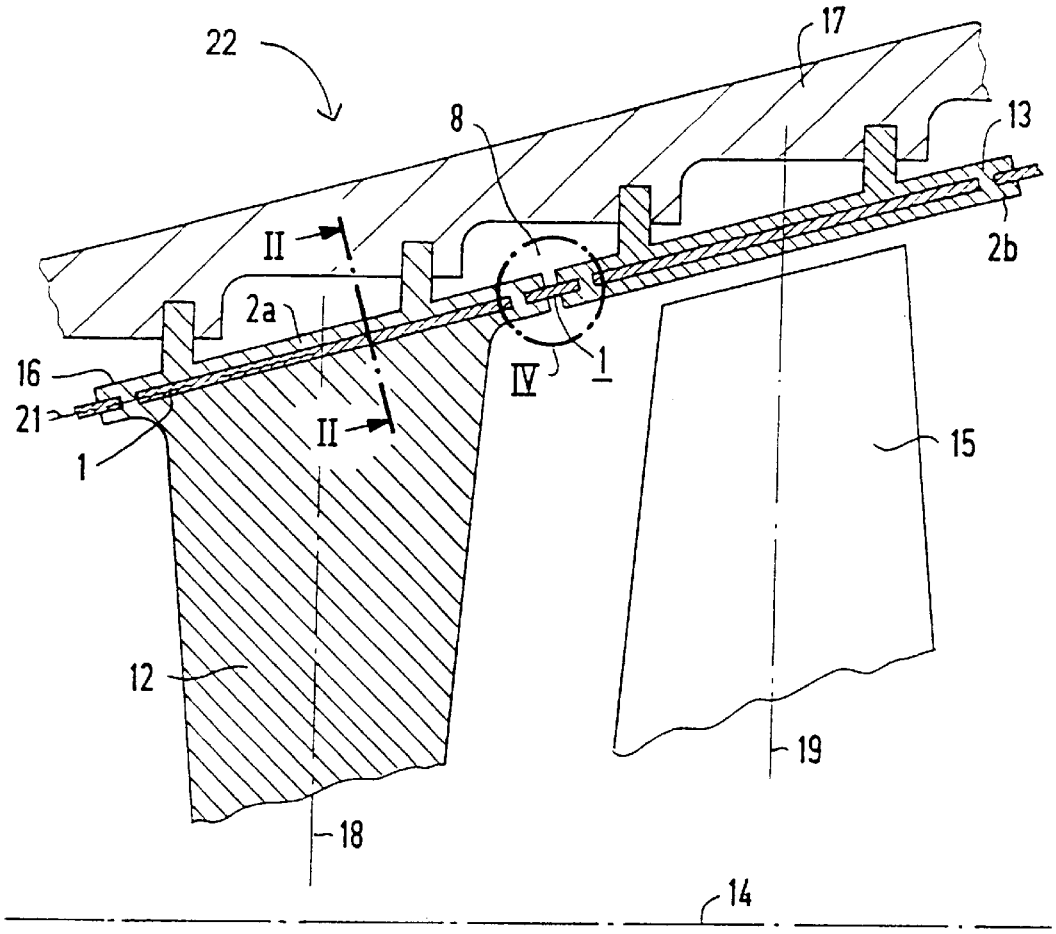
FIG. 1 is a fragmentary, diagrammatic, longitudinal-sectional view of a gas turbine plant.

Referring now to the figures of the drawings in detail and first, particularly, to FIG. 1 thereof, there is seen a gas turbine plant 22 directed along a main axis 14. The gas turbine plant 22 has guide blades 12 and moving blades 15, alternating in the axial direction in a casing 17. The guide blades 12 are directed along an axis 18 perpendicular to the main axis 14 and are disposed along the circumference of the gas turbine plant 22 so as to form a circle. The guide blades 12 are each connected to the casing 17 of the gas turbine plant 22 through a guide blade plate 16. Adjacent guide blades 12 are spaced from one another along the circumference through the use of a respective gap 5 (see FIG. 2), with the result that they can essentially freely expand thermally. The guide-blade plate 16 separates a hot-gas region 11 formed about the main axis 14 of the gas turbine plant 22 from a cooling gas region 8 formed between the guide-blade plate 16 and the turbine casing 17. The moving blades 15 extend along a respective main axis 19 which is likewise essentially orthogonal to the main axis 14 of the gas turbine plant. The moving blades 15 lie completely within the hot-gas region 11. This hot-gas region 11 is separated from the cooling-air region 8 by a plurality of wall components 13 along the circumference of the gas turbine plant 22. In this case, the wall components 13 are each adjacent the moving blades 15. The wall components 13 are connected to the turbine casing 17. For the sake of clarity, in each case only one guide blade 12, one moving blade 15 and one wall component 13 are shown. A respective wall component 13 is spaced from a respective guide blade 12, in particular from the guide-blade plate 16, in the axial direction through the use of a gap 5. This gap 5 is sealed off by a sealing element 1, thereby largely preventing a flow of cooling gas out of the cooling-gas region 8 into the hot-gas region 11. In this case, the guide plate 12 constitutes a first component 2*a* and the wall part 13 a second component 2*b*. Thus, sealing-off of the cooling-gas region 8 from the hot-gas region 11 between adjacent guide blades 12 and wall components 13 takes place in a circumferential direction and, in each case, sealing-off between adjacent guide blades 12 and correspondingly between adjacent wall components 13 takes place in a circumferential direction.

Figure 2:
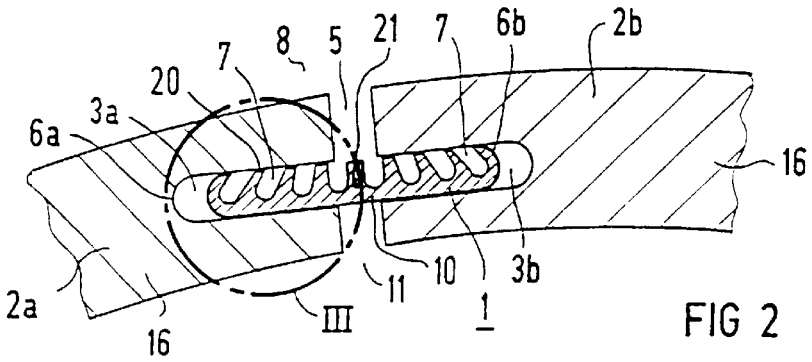
FIG. 2 is an enlarged, fragmentary, cross-sectional view taken along a line II—II of FIG. 1, in the direction of the arrows showing a sealing element in a gas turbine plant.

FIG. 2 shows a cross-section along the circumference of the gas turbine plant 22 and, in particular, it shows two adjacent components 2*a*, 2*b* which are spaced from one another through the use of a gap 5, on an enlarged scale. In each case the components 2*a*, 2*b* can be two adjacent guide blades 12, particularly guide-blade plates 16, and two wall components 13 adjacent one another. A component groove 3*a*, 3*b* is provided in each of the components 2*a*, 2*b* in the circumferential direction. The sealing element 1 having a toothed contour engages into the component grooves 3*a*, 3*b* so as to seal the gap 5. The sealing element 1 is directed along a main line 21 and, in the illustrated cross-section which is perpendicular to the main line 21, it has a first end 6*a*, a second end 6*b* and an intermediate middle region 10. The sealing element 1 has a plurality of sealing grooves 7 directed towards the cooling-gas region 8 and a sealing tip (sealing tooth) 20 which is formed in each case between adjacent sealing grooves 7 and bears sealingly onto the corresponding component groove 3*a*, 3*b*. Since, as a rule, the pressure of the cooling gas is higher than the pressure of the hot gas in the region 11 carrying hot gas, the sealing element 1 rests with its smooth surface on the component grooves 3*a*, 3*b*, so that the sealing tips 20 are largely relieved of mechanical load. The wear of the sealing element 1 is thereby markedly reduced.

Figure 3:
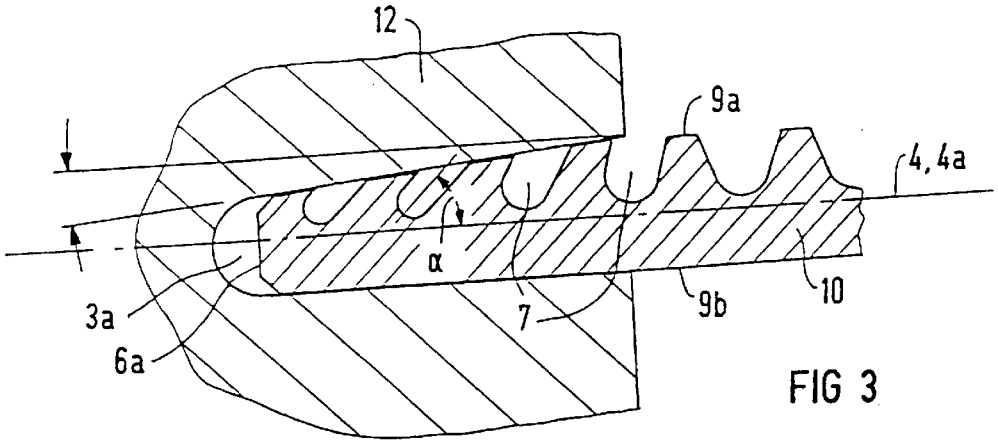
FIG. 3 is a further enlarged, fragmentary, view of a portion III of FIG. 2 showing a sealing element in a gas turbine plant.

FIG. 3 shows an enlarged representation of the sealing element 1 according to FIG. 2. A smooth surface 9*b* faces the region 11 carrying hot gas and a profiled surface 9*a* having the sealing grooves 7 and the intermediate sealing tips 20 faces the cooling-gas region 8. The sealing element 1 has a body which narrows from its middle region 10 towards the respective ends 6*a*, 6*b*. The component groove 3*a* likewise narrows from the gap 5 into the component 2*a*, namely the guide-blade plate 16. The sealing grooves 7 have an angle of inclination $\alpha$ relative to a center line 4 which is, in particular, a main axis 4*a* of the sealing element 1. This angle of inclination $\alpha$ is approximately 90° in the middle region, so that there, the sealing grooves 7 run essentially orthogonal to the center line 4. The angle of inclination $\alpha$ of the sealing grooves 7 decreases, particularly continuously, towards the end 6*a*. This affords a deformability of the sealing element 1 in the event of thermal expansion, in particular compression of the component groove 3*a*. Thus, in the event of thermal expansion of the component 2*a* and consequently compression of the component groove 3*a*, the sealing element 1 leads to constant or even improved sealing-off, while the thermal stresses are kept low. A sealing element 1 having sealing grooves 7 is preferably used for sealing off a gap between adjacent guide blades 12 or adjacent wall components 13 on the periphery of the gas turbine plant.

Figure 4:
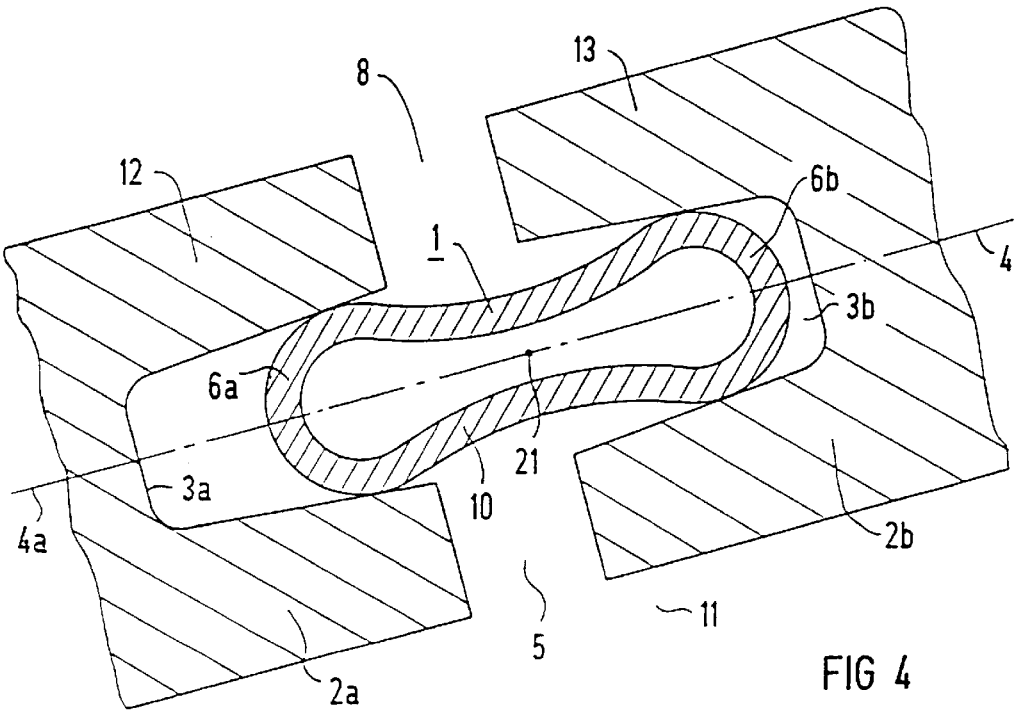
FIG. 4 is a further enlarged, fragmentary, view of a portion IV of FIG. 1 showing a sealing element in a gas turbine plant.

FIG. 4 shows a sealing element 1 for sealing off a gap 5 in the axial direction of the gas turbine plant 22 between a first component 2*a* which is a guide blade 12 and a second component 2*b* which is a wall component 13 of the gas turbine plant 22. The sealing element 1 is a hollow body which extends along the main line 21. As seen in cross-section, the sealing element 1 is essentially symmetrical relative to the center line 4 and is thicker at its ends 6*a*, 6*b* than in its middle region 10. The sealing element 1 has approximately the shape of a dumbbell. As a result, the ends 6*a*, 6*b* projecting into the component grooves 3*a*, 3*b* bring about effective sealing of the gap 5. In the event of thermal expansion of the components 12, 13 together with compression of the corresponding component grooves 3*a*, 3*b*, the sealing element 1 is likewise compressed and is stretched along its center line 4. This guarantees that the sealing element 1 bears sealingly in the component grooves 3*a*, 3*b* during all of the operating phases of the gas turbine plant 22.

The invention is distinguished by a sealing element for sealing a gap between two components, particularly of a gas turbine plant, with the sealing element extending along a main line, namely a longitudinal axis, and having a profiled cross-section. In cross-section, the sealing element is directed along a center line and is deformable in a direction essentially orthogonal to the center line. The sealing element serves particularly for sealing off components which are adjacent on one side to a cooling-gas region and on an opposite side to a region carrying hot gas over the gas turbine. The components have component grooves, and the sealing element can be inserted along its center line into the component grooves of components that are adjacent one another. The deformability of the sealing element guarantees that the sealing element engages sealingly into the component grooves during each operating phase of the gas turbine plant, particularly at high temperatures of more than 1000° C.

We claim:

1. In an assembly including two mutually thermally movable components each having a component groove, a sealing element directed along a main line for sealing a gap between the components, the sealing element comprising:

a first end, a second end and a middle region, in a cross-section substantially perpendicular to the main line, said middle region disposed between said ends and having a toothed surface.

2. The sealing element according to claim 1, wherein said toothed surface is a first surface, and including a smooth second surface disposed opposite said first surface relative to a center line.

3. The sealing element according to claim 1, including a plurality of sealing grooves each inclined at an angle of inclination of 50° to 90° relative to a center line.

4. The sealing element according to claim 3, wherein said sealing grooves are inclined so as to ascend towards said middle region.

5. The sealing element according to claim 3, wherein said sealing grooves have a smaller angle of inclination at said ends than i n said middle region.

6. The sealing element according to claim 5, wherein said angle of inclination is 90° in said middle region.

7. The sealing element according to claim 1, including a body narrowing from said middle region towards said ends.

8. In a gas turbine plant having adjacent components including guide blades and wall components defining a gap therebetween and each having a component groove, a hot-gas region, and a cooling-gas region to be sealed off from the hot-gas region for cooling the guide blades, a sealing element directed along a main line and engaging into a component groove of one of the components and into a component groove of another of the components for sealing the gap, the sealing element comprising:

a first end, a second end and a middle region, in a cross-section substantially perpendicular to the main line, said middle region disposed between said ends and having a toothed surface.

9. The sealing element according to claim 8, wherein said end to be introduced into a respective component groove is slightly oversized relative to the component groove.

10. The sealing element according to claim 8, wherein the component groove to be engaged narrows into the component in a direction away from the gap.

11. The sealing element according to claim 8, wherein said toothed surface faces the cooling-gas region.

12. A gas turbine plant, comprising:

a plurality of components disposed in axial and circumferential direction, said components including guide-blade plates of guide blades and wall components, at least a first and a second of said components spaced apart in the circumferential direction by a gap, and each of said components having a component groove facing said gap;

regions mutually separated by said components, said regions including a hot-gas region and a cooling-gas region to be sealed off from said hot-gas region for cooling the guide blades; and a toothed sealing element disposed in said component grooves for sealing said gap.

13. The gas turbine plant according to claim 12, wherein said gap is disposed between two axially spaced apart components, and said sealing element sealing off said gap is a dumbbell or figure-eight-shaped hollow body.

* * * * *